US005131903A

United States Patent [19]

Levine et al.

[11] Patent Number: 5,131,903

[45] Date of Patent: Jul. 21, 1992

[54] APPARATUS FOR CRUMPLING AND DISPENSING PAPER-LIKE DUNNAGE

[75] Inventors: Sanford I. Levine; Larry A. Levine, both of Wayne; Neal T. Levine, North Caldwell, all of N.J.

[73] Assignee: Sanford Levine and Sons Packaging Corp., Fairfield, N.J.

[21] Appl. No.: 675,341

[22] Filed: Mar. 25, 1991

[51] Int. Cl.[5] ..... B31F 1/00; B31F 1/22; B65D 85/676

[52] U.S. Cl. ..... 493/464; 206/395; 206/408; 206/409; 225/52; 225/106

[58] Field of Search ..... 206/233, 395, 396, 408, 206/409, 494; 225/52, 106; 493/464

[56] References Cited

U.S. PATENT DOCUMENTS

| | | | |
|---|---|---|---|
| 2,806,591 | 9/1957 | Appleton | 225/106 |
| 3,509,797 | 5/1970 | Johnson . | |
| 3,509,798 | 5/1970 | Johnson . | |
| 3,603,216 | 9/1971 | Johnson . | |
| 3,613,522 | 10/1971 | Johnson . | |
| 3,655,500 | 4/1972 | Johnson . | |
| 3,799,039 | 3/1974 | Johnson . | |
| 4,026,198 | 5/1977 | Ottaviano . | |
| 4,085,662 | 4/1978 | Ottaviano . | |
| 4,098,468 | 7/1978 | Skalleberg . | |
| 4,109,040 | 8/1978 | Ottaviano . | |
| 4,685,633 | 8/1987 | Pellini . | |
| 4,699,609 | 10/1987 | Komaransky . | |
| 4,717,613 | 1/1988 | Ottaviano . | |
| 4,747,816 | 5/1988 | Matsuyama et al. . | |
| 4,750,896 | 6/1988 | Komaransky . | |

*Primary Examiner*—William E. Terrell
*Attorney, Agent, or Firm*—Richard M. Goldberg

[57] ABSTRACT

Apparatus for crumpling and dispensing dunnage from a roll of stock paper material, includes a frame having a pair of side walls for guiding sheet paper from the roll of paper in a converging manner, each side wall including an inclined central section for guiding the sheet paper in the converging manner and two angle supports for supporting the inclined central section in an inclined manner, two roll supports for supporting the roll of paper at a diverged end of the pair of side walls, a connecting section for connecting the pair of side walls at a converged end of the pair of side walls, the connecting section including a reduced dimension corrugated-shaped opening for crumpling the converging paper exiting therethrough, for substantially maintaining the paper in the crumpled form and for maintaining a portion of the crumpled paper in an extended manner through the opening; and a box-like housing for holding the frame, the box-like housing including an opening in alignment with the reduced dimension opening.

17 Claims, 5 Drawing Sheets

FIG.3
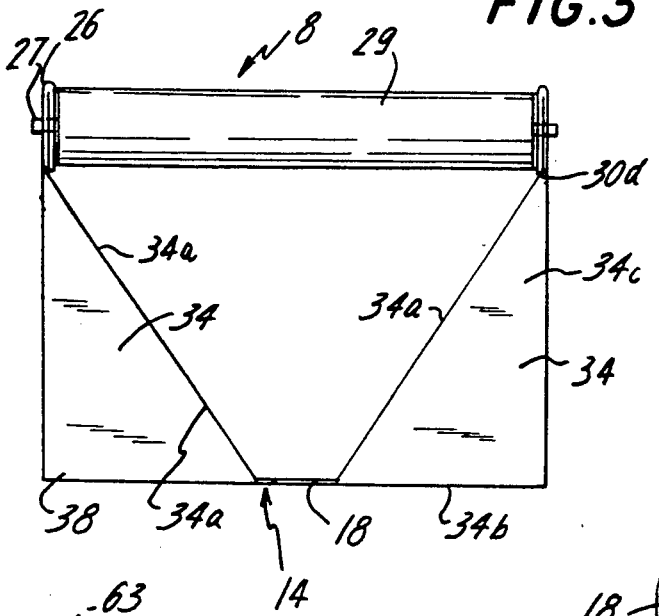
FIG.5
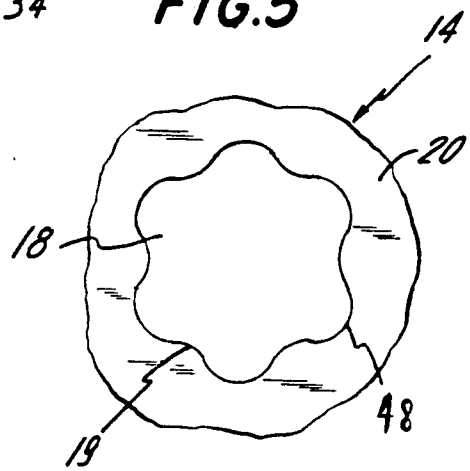
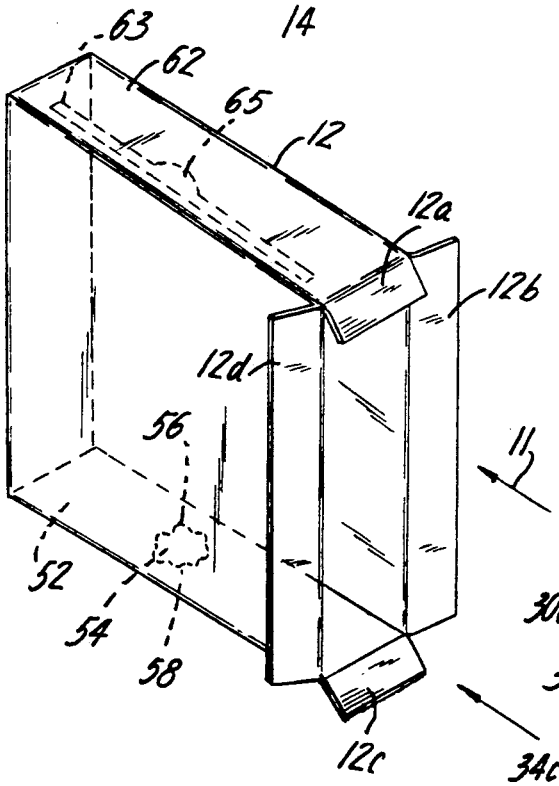
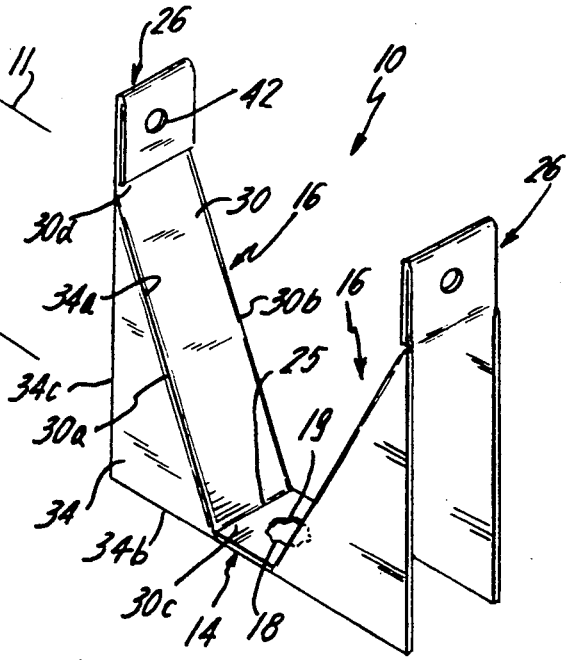
FIG. 4

APPARATUS FOR CRUMPLING AND DISPENSING PAPER-LIKE DUNNAGE

BACKGROUND OF THE INVENTION

The present invention relates generally to an apparatus for crumpling and dispensing dunnage from a roll of flexible, stock paper material, and more particularly, to a disposable, dunnage dispensing apparatus which structurally reinforces its outer housing and which maintains a length of dunnage dispensed therefrom in a crumpled state.

Dunnage refers generally to packing material used to insulate the contents of shipping boxes from shocks and jolts incurred during transit and to fill voids in the shipping boxes. Various known forms of dunnage include the use of styrofoam pellets, popped corn, crumpled paper or paper padding in various forms. One form of paper dunnage, which is very well-known in the art, is provided in a strip form from flexible sheet-like stock material. The edges of the stock material are rolled inwardly to form a strip of pillow-like resilient portions. The strip is subsequently cut to the desired length.

U.S. Pat. No. 3,509,798 to Johnson is representative of a large group of Patents disclosing rather complicated mechanisms for producing dunnage comprising highly resilient pillow-like strips. Similar dunnage-making mechanisms and methods are disclosed in U.S. Pat. Nos. 3,603,216 to Johnson; 3,613,522 to Johnson; 3,655,500 to Johnson; 3,799,039 to Johnson; 4,026,198 to Ottaviano; 4,085,662 to Ottaviano; 4,109,040 to Ottaviano; 4,717,613 to Ottaviano; 4,699,609 to Komaransky and 4,750,896 to Komaransky.

U.S. Pat. Nos. 3,509,797 and 3,613,522 to Johnson disclose a method and machine for producing coiled, resilient cushioning dunnage by crumpling a continuous web of sheet-like material into a narrow strip. Beveled gears pull the sheet-like material through a funnel-like arrangement and also cause coiling and rotation of the coiled strip. At a distance below the beveled gears which rotate the strip, there is an interruption of the rotation, thereby kinking the strip, the rotation subsequently being resumed thereafter.

All of the methods and machines for making paper dunnage disclosed in the above-mentioned Patents rely on an intricate array of intermeshed gears and/or rollers for pulling the paper stock material and for compacting the same. Those machines that have intermeshed gearing produce dunnage which is coined or stitched for maintaining the dunnage in a crumpled form.

Such intricate machinery is not inexpensive, nor is it disposable. Furthermore, the machinery disclosed above is not easily transportable. Therefore, these known machines are suitable primarily for large-scale dunnage production and are impractical due to considerations of expense and convenience for environments such as small retail establishments, mail order houses, small shipping departments, the moving industry, individuals and the like.

Other Patents of related interest are U.S. Pat. Nos. 4,098,468 to Skalleberg; 4,685,633 to Pellini; and 4,747,816 to Matsuyama et al.

OBJECTS AND SUMMARY OF THE INVENTION

Accordingly, it is an object of the present invention to provide a mechanism for producing dunnage which is extremely economical to use.

Another object of the present invention is to provide an apparatus for crumpling and dispensing dunnage from a roll of stock paper material which is relatively simple to produce.

Yet another object of the present invention is to provide an apparatus for crumpling and dispensing dunnage comprising a package which may be ecologically disposed of after use.

Still another object of the present invention is to provide an apparatus for crumpling and dispensing dunnage which may be easily transported.

A further object of the present invention is to provide an apparatus for crumpling and dispensing dunnage which will provide additional support to its outer package, thereby preventing the packages from being crushed when stacked one upon the other.

Yet a further object of the present invention is to provide an apparatus for crumpling and dispensing dunnage which is suitable for small-scale users.

Still a further object of the present invention is to provide an apparatus for crumpling and dispensing dunnage, while maintaining the dunnage in a crumpled state after dispensing.

Another object of the present invention is to provide an apparatus for crumpling and dispensing dunnage that maintains the dunnage in an exposed, extended state for easy grasping by a user.

Yet another object of the present invention is to provide an apparatus for crumpling and dispensing dunnage which permits alternative dispensing of the paper in a sheet-like manner.

The present invention relates to an apparatus for crumpling and dispensing dunnage from a roll of stock paper material. The apparatus includes a pair of inclined side wall members for supporting roll support means which further supports the roll of stock paper material therebetween. The pair of side wall members are connected by a connecting member, the connecting member having an opening sized such that paper from the roll of stock paper material is compacted when pulled through the opening. The opening has means associated therewith for crumpling and crimping the compacted paper which is drawn therethrough, which crumpling and crimping substantially maintains the paper in the compacted form. Furthermore, the means for crumpling and crimping the paper associated with the opening also maintains a portion of the crumpled paper extending through the opening, exposed after the compacted product has been removed, in order to permit grasping by a user of the next piece of material.

The above apparatus is received into a housing which has an opening positioned in one wall thereof corresponding in position to the opening of the connecting member. The housing opening has means associated therewith for further crumpling and compacting the compacted paper which is drawn therethrough, thereby substantially maintaining the paper in the compacted form. Additionally, a side of the housing may be provided with a slot which is substantially the same length as and parallel to the longitudinal axis of the roll of stock paper material.

Therefore, a user may alternatively withdraw dunnage from the housing by pulling the stock paper material through the apparatus opening and housing opening, or withdraw uncrumpled paper by pulling the stock paper material through the housing slot, bypassing the apparatus opening.

In accordance with an aspect of the present invention, apparatus for crumpling and dispensing dunnage from a roll of paper, includes a frame having a pair of side wall means for guiding sheet paper from the roll of paper in a converging manner, roll support means for supporting the roll of paper at a diverged end of the pair of side wall means, and connecting means for connecting the pair of side wall means at a converged end of the pair of side wall means, the connecting means including reduced dimension opening means for crumpling the converging paper exiting therethrough; and box-like housing means for holding the frame, the box-like housing means including an opening in alignment with the reduced dimension opening means.

In accordance with another aspect of the present invention, apparatus for crumpling and dispensing dunnage from a roll of paper, includes a pair of side wall means for guiding sheet paper from the roll of paper in a converging manner, each side wall means including inclined means for guiding the sheet paper in the converging manner and angle support means for supporting the inclined means in an inclined manner; roll support means for supporting the roll of paper at a diverged end of the pair of side wall means; and connecting means for connecting the pair of side wall means at a converged end of the pair of said wall means, the connecting means including reduced dimension opening means for crumpling the converging paper exiting therethrough.

In accordance with still another aspect of the present invention, apparatus for crumpling and dispensing dunnage from a roll of paper, includes a pair of side wall means for guiding sheet paper from the roll of paper in a converging manner; roll support means for supporting the roll of paper at a diverged end of the pair of side wall means; connecting means for connecting the pair of side wall means at a converged end of the pair of side wall means, the connecting means including reduced dimension opening means for crumpling the converging paper exiting therethrough; and means associated with the opening means for substantially maintaining the paper in the crumpled form and for maintaining a portion of the crumpled paper in an extended manner through the opening.

In accordance with yet another aspect of the present invention, a blank for forming an apparatus for crumpling and dispensing dunnage from a roll of paper, includes a central portion having a reduced dimension opening therein, the central portion having opposite edges; a pair of side wall portions, each side wall portion including a central section having a first edge, a second opposite edge and a third edge between the first and second edges, the first edge of each side wall portion being connected to the central portion at one opposite edge thereof along a respective fold line, at least one angle support portion connected to the third edge of each central section along a respective fold line; and a pair of paper roll support sections, each paper roll support section extending from the second edge of one central section along a respective fold line, each paper roll support section having at least one roll support opening therein.

In accordance with yet another aspect of the present invention, apparatus for crumpling and dispensing dunnage from a roll of paper, includes a) a frame having i) a pair of side wall means for guiding sheet paper from the roll of paper in a converging manner, each side wall means including inclined means for guiding the sheet paper in the converging manner and angle support means for supporting the inclined means in an inclined manner, ii) roll support means for supporting the roll or paper at a diverged end of the pair of side wall means, iii) connecting means for connecting the pair of side wall means at a converged end of the pair of side wall means, the connecting means including reduced dimension opening means for crumpling the converging paper exiting therethrough, and iv) means associated with the opening means for substantially maintaining the paper in the crumpled form and for maintaining a portion of the crumpled paper in an extended manner through the opening; and b) box-like housing means for holding the frame, the box-like housing means including an opening in alignment with the reduced dimension opening means.

The above and other objects, features and advantages of the present invention will become readily apparent from the following detailed description thereof which is to be read in conjunction with the accompanying drawings.

BRIEF DESCRIPTION OF THE DRAWINGS

FIG. 3 is a front elevational view of the inner frame illustrated in FIG. 2, the inner frame being shown having a roll of stock paper material received therein;

FIG. 4 is a perspective view of the apparatus of FIG. 1, illustrating insertion of the inner frame into the outer housing;

FIG. 5 is a plan view of a portion of the inner frame of the apparatus for crumpling and dispensing paper-like dunnage illustrated in FIG. 2;

DETAILED DESCRIPTION OF THE PREFERRED EMBODIMENTS

Figure 1:
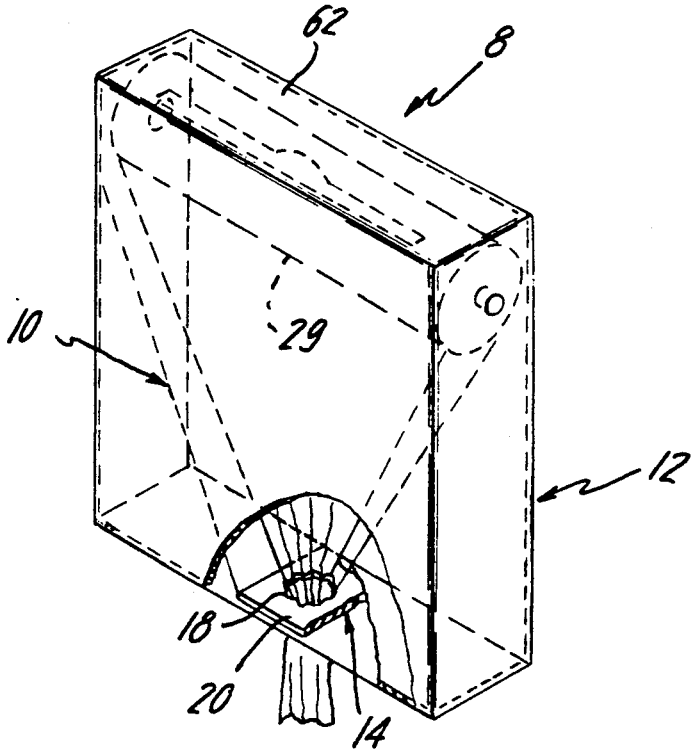
FIG. 1 is a perspective view of an apparatus for crumpling and dispensing paper-like dunnage in accordance with a first embodiment of the present invention, a portion thereof having been broken away for purposes of clarification and discussion thereof.

Referring to the drawings in detail, and initially to FIGS. 1-5 thereof, an apparatus 8 for crumpling and dispensing paper-like dunnage according to the present invention includes an inner frame 10 received inside a housing or box 12 in a manner which will be described more fully hereinbelow.

Inner frame 10 comprises a connecting member 14 and a pair of side wall members 16 which are bilaterally disposed on either side of connecting member 16 and attached thereto. Connecting member 14 has an opening 18 centrally disposed therein, opening 18 having associated therewith means 19 for crumpling and crimping paper which is pulled therethrough and for maintaining the paper in a crumpled and crimped state, which means 19 will be more fully described below.

Specifically, when a sheet of paper is pulled through opening 18, the paper is crumpled to form dunnage. The paper can be single, double or triple ply paper. However, such dunnage will have a tendency to expand upon exiting hole 18. To prevent substantial expansion thereof, means 19 comprises corrugations 48 which are incorporated around the edge of opening 18 in order to crumple and crimp, in an irregular manner, paper which is pulled therethrough. The irregularity of crumpling results in the dispensed dunnage product retaining its crumpled shape to a much greater extent than for the case where paper is drawn through a perfectly circular opening. In other words, corrugations 48 add kinks or crimps in the compaction pattern, which help maintain the paper in a compacted state. In addition, for situations where the paper supply is positioned below opening 18, corrugations 48 help to maintain the leading end of the paper extending through opening 18 so that it can be grasped by a user. Otherwise, with a purely circular opening, the paper dunnage, after being torn off at opening 18, could fall back through opening 18, thereby rendering subsequent operations difficult. It will be appreciated, however, that, although a regular sinusoidal-type pattern (FIG. 5) has been shown for means 19, any other suitable pattern can be used.

Figure 2:
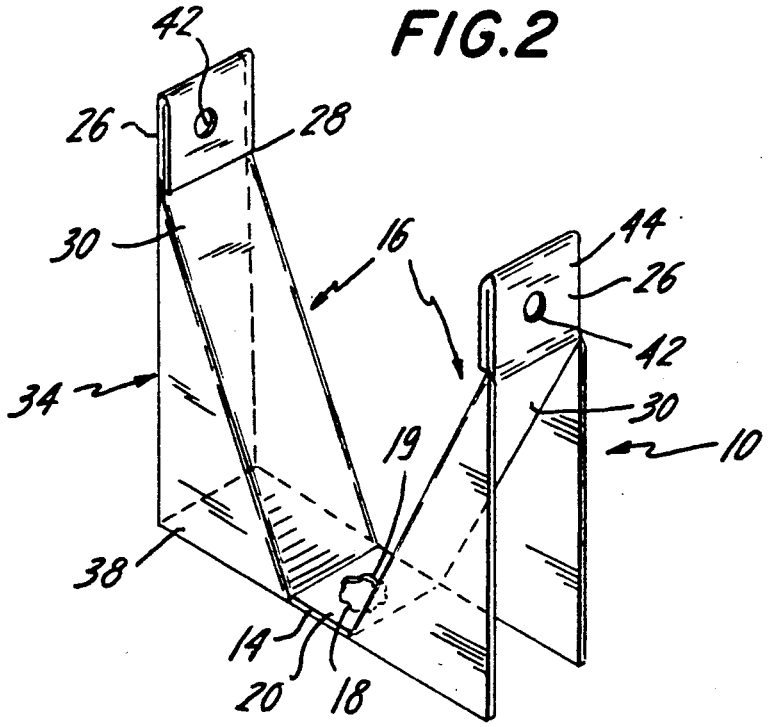
FIG. 2 is a perspective view of the inner frame of the apparatus for crumpling and dispensing paper-like dunnage of FIG. 1.

As shown best in FIGS. 2 and 4, side wall members 16 are connected to opposite edges 25 of connecting member 14, and extend outwardly therefrom in a diverging manner. Specifically, each side wall member 16 is formed with an elongated, substantially rectangular, planar central section 30 having opposite longer edges 30*a* and 30*b* and opposite shorter edges 30*c* and 30*d*. Shorter edges 30*c* of central sections 30 are integrally formed with connecting member 14 at opposite edges 25 thereof and extend outwardly therefrom in a diverging manner.

Each side wall member 16 further includes two angle support portions 34, each having a planar, substantially right triangle configuration, with hypotenuses 34*a* thereof being integrally connected to opposite longer edges 30*a* and 30*b* of central section 30, and bent outwardly at right angles therefrom. In this manner, the two angle support portions 34 associated with each central section 30 are arranged in a substantially parallel, spaced relation to each other, with one edge 34*b* of each angle support portion, opposite the hypotenuse 34*a* thereof, being substantially coplanar with connecting member 14 in order to form a support for central sections 30 so as to maintain the same in the aforementioned inclined, diverging relation. Accordingly, the third edge 34*c* of each angle support portion 34 is substantially perpendicular to edge 34*b*.

Figure 8:
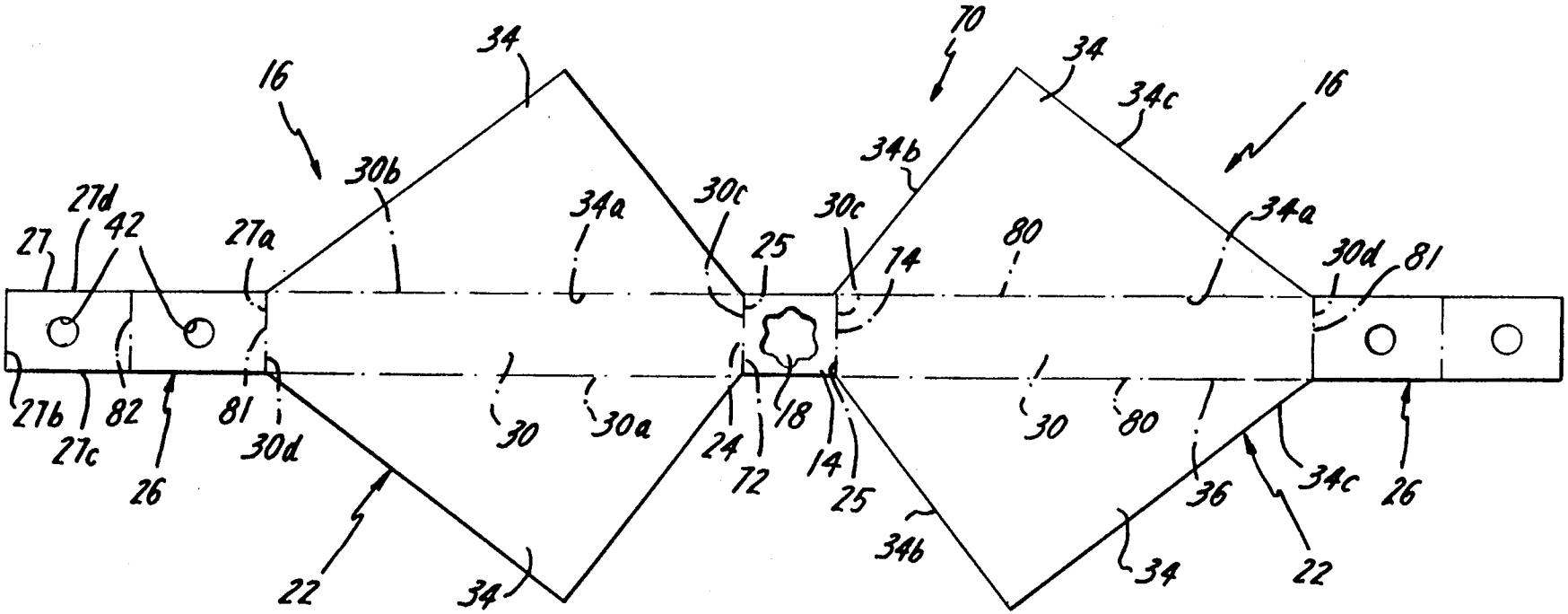
FIG. 8 is a plan view of an unfolded blank for constructing the inner frame of the apparatus for crumpling and dispensing paper-like dunnage illustrated in FIG. 2.

Inner frame 10 further includes a roll support portion 26 connected to the free shorter edge 30*d* of each central section 30 for supporting a roll 29 of stock paper material. Specifically, each roll support portion 26 is constituted by a planar, substantially rectangular section 27, as best shown in FIG. 8, having opposite shorter edges 27*a* and 27*b*, and opposite longer edges 27*c* and 27*d*, with each shorter edge 27*a* being integrally formed with shorter edge 30*d* of the respective central section 30. Each rectangular section 27 is folded in half over itself along a fold line 82 such that shorter edges 27*a* and 27*b* are in adjacent, parallel relation in order to provide a thickening thereof, thereby providing reinforcement for supporting roll 29 of stock paper material. In this regard, support holes 42 are formed through the folded-over rectangular section so as to receive the pin ends 27 of roll 29 of stock paper material in order to rotatably support roll 29 therebetween.

Housing 12 comprises a rectangular box having dimensions sized to snugly receive inner frame 10.

In this regard, as shown best in FIG. 4, with the flaps 12*a*–12*d* at one side of box 12 being open, inner frame 10 is slid into box 12 in the direction of arrow 11 so as to fit snugly therein. Thereafter, flaps 12*a*–12*d* are closed in a fixed or removable manner. For example, a hot melt adhesive or the like can be used to seal flaps 12*a*–12*d* in a permanent manner. In such case, the entire assembly is thrown away after use. Alternatively, flaps 12*a*–12*d* can be closed by a removable closure. Any suitable and conventional removable closure can be used for this purpose in order to replace the roll 29 upon depletion thereof, or alternatively, to adjust the mode of operation between that of FIG. 1 or that of FIGS. 6 and 7 as will be discussed hereinafter.

Housing 12 is provided in one side 52 with an opening 54, which opening 54 is located such that it will be superimposed over and in substantial alignment with opening 18 when inner frame 10 is completely received and correctly oriented inside housing 12. In a preferred embodiment of the present invention, opening 54 similarly has associated therewith means 56 for crumpling paper which is pulled therethrough, which means 56 may comprise corrugations 58 similar to corrugations 48 around opening 18. Corrugations 58 may have the exact dimensions of corrugations 48, however, corrugations 58 could also be rotated about the axis of opening 54 several degrees, thereby placing corrugations 58 slightly out of alignment with corrugations 48 of opening 18. The kinking effect of having two series of corrugations 48 and 58 through which the paper is pulled further enhances the shape-retaining qualities of dunnage dispensed therethrough.

Thus, with the present invention, a roll of stock paper material can be pulled through openings 18 and 54 to produce dunnage. At the same time, corrugations 48 and 58 function to kink or crimp the dunnage in order to substantially maintain the shape of the dunnage as it passes through the openings. In other words, corrugations 48 and 58 have a tendency to prevent the crumpled paper from springing outwardly to an expanded state after passing through the openings. Still further, the corrugations 48 and 58 function to hold a portion of the crumpled paper extending from housing 12 outwardly thereof. For example, if housing 12 is oriented such that openings 18 and 54 face upwardly, the dunnage could fall back into housing 12 with a pure circular opening. With corrugations 48 and 58, on the other hand, a portion of the dunnage is always retained outside of the box so that the user always has paper to grasp. It will therefore be appreciated that the apparatus according to the present invention can stand in any position for dispensing.

It will further be appreciated that inclined side wall members 16 have a four-fold function to guide the paper from roll 29 to the crumpled state through openings 18 and 54, to support roll support portions 26 for holding roll 29, to prevent collapse of the apparatus during shipping when numerous boxes are stacked one upon the other and fourth, to provide that the entire holder 10 can be made inexpensively and disposable as a unitary blank, as will be explained hereinafter, while also being totally biodegradable.

Referring now to FIGS. 1, 4, 6 and 7, housing 12 further includes a bypass slot 60 provided in a side wall 62 of housing 12 opposite opening 54. The bypass slot 60 is parallel to the longitudinal axis of the roll 29 of stock paper material and is situated such that paper from the roll 29 of stock paper material may be dispensed therethrough without crumpling. In such case, the paper from roll 29 would not extend between inner frame 10 or through openings 18 or 54. Further, edge 62 may be provided with serrations 65 or the like for tearing the paper, or alternatively, the paper can be provided with perforations 29*a* (FIG. 6) for tearing.

Figure 6:
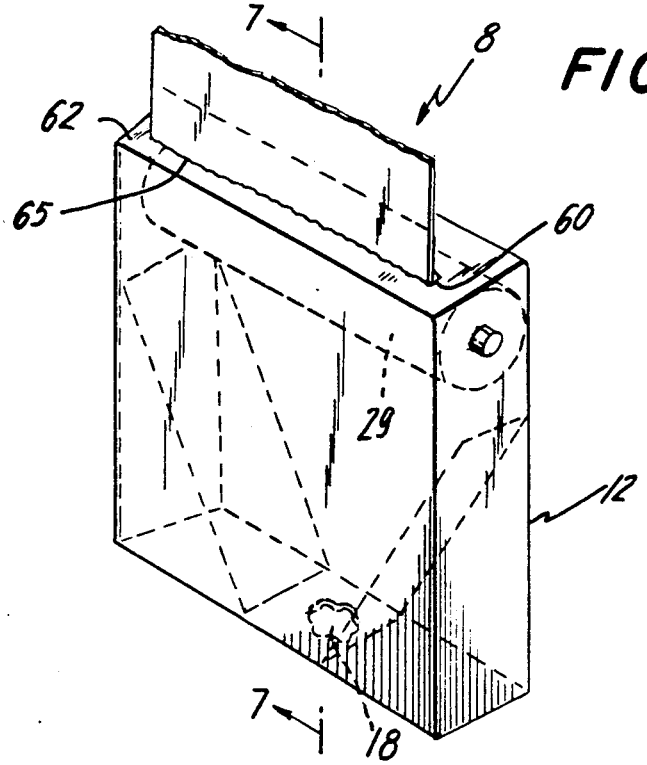
FIG. 6 is a perspective view of the apparatus of FIG. 1, showing use of the same for dispensing sheet-like paper.
Figure 7:
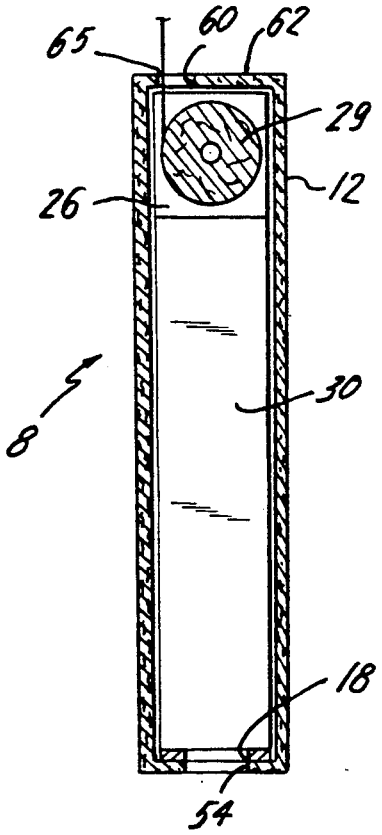
FIG. 7 is a cross-sectional view of the apparatus illustrated in FIG. 6, taken along line 7—7 thereof.

As shown in FIGS. 1 and 4, side wall 62 of housing 12 is preferably provided with a perforated section 63 with a finger push-in portion 65 in order to enable the user to remove section 63 as a tear strip so as to produce bypass slot 60. Thereafter, the user merely inserts his fingers through bypass slot 60 in order to grasp the paper from roll 29 and pull it through bypass slot 60. Therefore, the paper may be used for wrapping articles prior to their being surrounded with dunnage or in other situations where dunnage is not desired for the particular application. In the case where flaps 12*a*–12*d* of housing 12 can be reopened, the apparatus can continuously be changed to produce crumpled paper as shown in FIG. 1 or sheet-like paper as shown in FIG. 6.

Although inner frame 10 has been described as being constructed from discrete units which have been attached by conventional means, it is also possible, and in fact preferable, to construct inner frame 10 from a single, inexpensive blank 70 made of cardboard, plastic, or some other similarly flexible or foldable sheet material.

With reference to FIG. 8, one-piece blank 70 for assembly into an inner frame 10 for use in the apparatus for crumpling and dispensing dunnage from a roll of stock paper material comprises centrally positioned connecting member 14 having a substantially rectangular shape and further including central opening 18 through which paper stock material will be withdrawn in compacted form. Side wall members 16 are symmetrical and extend from opposite edges 25 of connecting member 14.

Specifically, shorter edges 30*c* of side wall members 16 are integrally formed at opposite edges 25 of connecting member 14 along fold lines 72 and 74, respectively, to permit folding of side wall member 16 in the aforementioned outwardly diverging manner from connecting member 14. The hypotenuses 30*a* of triangular support portions 34 are integrally formed with longer edges 34*a* of central sections 30, as aforementioned, along fold lines 80 so as to be bendable or foldable with respect to central sections 30 at right angles thereto in the manner shown in FIGS. 2 and 4. Finally, blank 70 includes a rectangular roll support portion 26 connected at shorter side 27*a* thereat to the opposite shorter side 30*d* of each central section 30, along a fold line 81 thereat. In this manner, each roll support portion 26 can be bent about fold line 81 so as to be substantially coplanar with edges 34*c* of triangular support sections 34, as shown in FIGS. 2 and 4. In addition, the rectangular portion of each roll support portion 26 is provided with a fold line 82 which equally divides rectangular portion 27 into two equal halves and with fold line 82 being in parallel, spaced relation to fold line 81. Each half is provided with a roll support hole 42, as aforementioned. Support holes 42 are equidistant from fold line 82 and are substantially medially positioned on roll support portion 26 such that support holes 42 are superimposed one upon the other when roll support portion 26 is folded back on itself at fold line 82.

Figure 9:
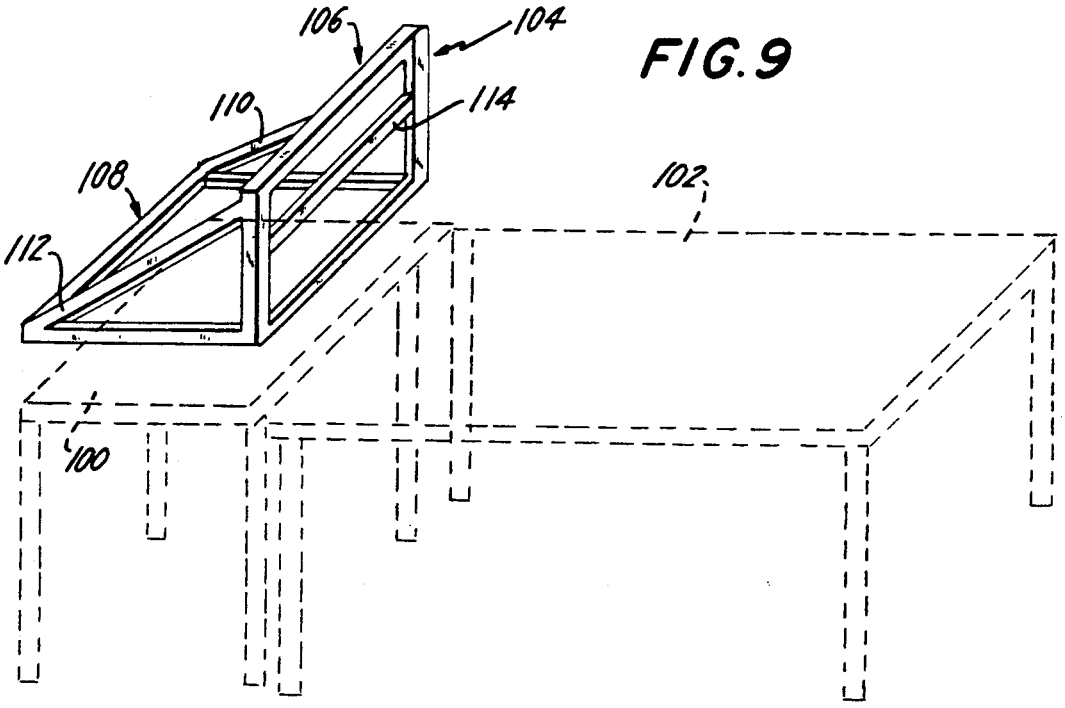
FIG. 9 is a schematic perspective view of a holder for holding the apparatus of FIG. 1 adjacent a packing table.

As shown in FIG. 9, a holder 104 can be provided for holding apparatus 8 on a rolling table 100 adjacent a packing table 102. Holder 104 has a substantially L-shaped configuration with a first vertically oriented rectangular frame section 106 connected at one end to a horizontally oriented rectangular frame section 108 which rests upon table 100. Side triangular support sections 110 and 112 are connected at opposite edges to rectangular sections 106 and 108. Further, a tear bar 114 is provided across opposite ends of rectangular frame section 106. Tear bar 114 holds the box in frame section 106, that is, prevents the box from falling through frame section 106. and also permits tearing the paper thereacross. Depending upon the use required, either openings 18 and 54, or bypass slot 160, is exposed through rectangular section 106 for use by a worker with respect to providing packing material at table 102.

Figure 10:
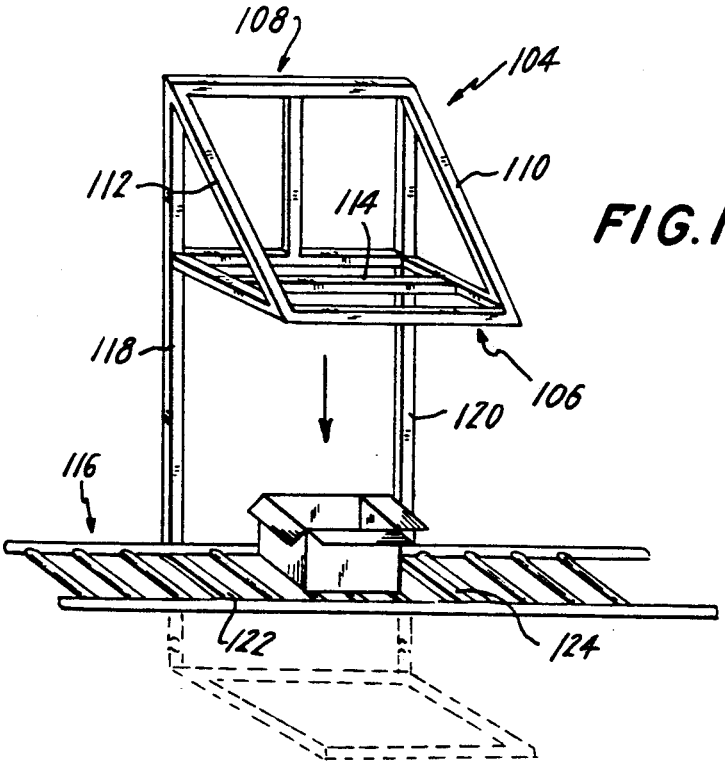
FIG. 10 is a schematic perspective view of the holder of FIG. 9 mounted above a conveyer line.

Alternatively, holder 104 can be mounted on a wall (not shown) over a packing table. Still further, as shown in FIG. 10, holder 104 can be mounted over a conveyer 116. In this regard, rectangular frame section 106 is horizontally oriented while rectangular frame section 108 is vertically oriented and is connected with frame bars 118 and 120 which are also clamped to conveyer 116 and mounted thereunder by clamp bars 122 and 124, shown schematically in FIG. 10. Support bars 118 and 120 can be extended below conveyer 116, as shown in dashed lines, to provide extra strength. In this regard, as shown in FIG. 10, apparatus 8 can be mounted immediately above a packing line.

It will be understood that the embodiments described herein are merely exemplary and that a person skilled in the art may make many variations, combinations and modifications without departing from the spirit and the scope of the invention. All such modifications and variations are intended to be included within the scope of the invention as defined in the appended claims.

What is claimed is:

1. Apparatus for crumpling and dispensing dunnage from a roll of paper, comprising:

a) a frame including:

i) a pair of side wall means for guiding sheet paper from the roll of paper in a converging manner, ii) roll support means for supporting the roll of paper at a diverged end of the pair of side wall means, and iii) connecting means for connecting the pair of side wall means at a converged end of the pair of side wall means, the connecting means including reduced dimension opening means for crumpling the converging paper exiting therethrough; and b) box-like housing means for holding the frame, the box-like housing means including an opening in alignment with the reduced dimension opening means.

2. Apparatus according to claim 1, wherein each said side wall means includes inclined means for guiding the sheet paper in the converging manner and angle support means for supporting said inclined means in an inclined manner.

3. Apparatus according to claim 2, wherein said inclined means includes at least one side edge and said angle support means is connected to said at least one side edge and is bent at said side edge at an angle with respect to said inclined means.

4. Apparatus according to claim 3, wherein said inclined means includes a substantially rectangular central section having opposite shorter edges and opposite longer edges, and said angle support means includes at least one triangular angle support portion having a hypotenuse secured to at least one longer edge of said central section and bent at an angle with respect thereto so as to support said central section in an inclined manner.

5. Apparatus according to claim 4, wherein there are two said triangular angle support portions connected to opposite longer edges of said central section.

6. Apparatus according to claim 4, wherein each said triangular angle support portion has a substantially planar, right triangular configuration.

7. Apparatus according to claim 4, wherein said roll support means includes two roll support sections, each connected with a free shorter edge of said central section, and each roll support section having a roll support hole therethrough for rotatably supporting said roll of paper.

8. Apparatus according to claim 7, wherein each said roll support section includes two substantially planar superimposed sections.

9. Apparatus according to claim 1, further including means associated with at least one of the opening means in the frame and the opening in the housing means for substantially maintaining the paper in said crumpled form and for maintaining a portion of said crumpled paper in an extended manner through said opening in the housing means.

10. Apparatus according to claim 9, wherein said means associated with at least one of the opening means in the frame and the opening in the housing means, includes means for defining irregularities in said at least one of said opening means and said opening.

11. Apparatus according to claim 10, wherein said means for defining irregularities includes corrugations around an edge defining said at least one of said opening means and said opening.

12. Apparatus according to claim 1, wherein said housing means further includes means for dispensing sheet paper from said roll of paper in an uncrumpled form.

13. Apparatus according to claim 12, wherein said means for dispensing includes a slot in one edge of said housing means so that paper can be withdrawn from said roll, between said frame and said housing means, and through said slot.

14. Apparatus according to claim 13, wherein said slot is positioned on an opposite side of said housing means from said opening therein.

15. Apparatus according to claim 1, wherein said housing means has a rectangular box-like configuration and is made from a cardboard material.

16. Apparatus for crumpling and dispensing dunnage from a roll of paper, comprising:

a) a frame including:

i) a pair of side wall means for guiding sheet paper from a roll of paper in a converging manner, each said side wall means including inclined means for guiding the sheet paper in the converging manner and angle support means for supporting said inclined means in an inclined manner;

ii) roll support means supporting the roll of paper at a diverged end of said pair of side wall means;

iii) connecting means for connecting said pair of side wall means at a converged end of said pair of side wall means, said connecting means including reduced dimension opening means for crumpling said converging paper exiting therethrough; and iv) means associated with said opening means for substantially maintaining the paper in said crumpled form and for maintaining a portion of said crumpled paper in an extended manner through said opening; and b) box-like housing means for holding said frame, said box-like housing means including an opening in alignment with said reduced dimension opening means.

17. Apparatus according to claim 16, further including holding means for supporting said box-like housing means adjacent a work area.

* * * * *